United States Patent [19]

Senno et al.

[11] Patent Number: 4,625,425

[45] Date of Patent: Dec. 2, 1986

[54] UNIVERSAL TRIANGLE

[76] Inventors: Ricardo G. Senno, 46-63 Parsons Blvd., Flushing, N.Y. 11355; Pamela de Toledo, 382 State St., Brooklyn, N.Y. 11217

[21] Appl. No.: 782,480

[22] Filed: Oct. 1, 1985

[51] Int. Cl.[4] ..... B44D 3/30

[52] U.S. Cl. ..... 33/477; 33/565

[58] Field of Search ..... 33/403, 474, 477, 479, 33/486, 435, 420, 422, 564, 562, 563, 565

[56] References Cited

U.S. PATENT DOCUMENTS 413,497 10/1889 De Puy ..... 33/403

1,349,455 8/1920 Henriksen ..... 33/403

2,560,736 7/1951 Olson ..... 33/477

2,836,892 6/1958 Nisenson ..... 33/403

3,947,969 4/1976 Martinez ..... 33/565

*Primary Examiner*—Willis Little

*Attorney, Agent, or Firm*—Richard L. Miller

[57] ABSTRACT

This invention is a drafting implement consisting of an interchangeable triangle and interchangeable circular disk carried rotatively on the triangle and both the triangle and circular disk each being imprinted and having measurement and drafting aids to make technical drawings and measurements.

6 Claims, 10 Drawing Figures

UNIVERSAL TRIANGLE

BACKGOUND OF THE INVENTION

This invention relates to drafting instruments such as are used by draftsmen, engineers, graphic artists and educators and is an improvement over implements such as are presented in U.S. Pat Nos. 1,677,396, to Mickel; 1,972,122 to Woodyard; and 3,243,882 to Merrifield.

While many of such instruments have been developed in the past, most of them perform only a singular task or only a limited few thereof so that several drafting implements are usually needed to be at hand in order to accomplish a technical drawing. There is accordingly still a need for a drafting implement that can accomplish even more tasks than heretofore and cut down on drafting board clutter and save on drafting time.

SUMMARY OF THE INVENTION

Accordingly it is a principal object of the present invention to provide a universal triangle implement which can be used as a tool or aid for work incorporating engineering, architectural, graphic arts, geometry, science and other related disciplines and which can be used both as a device for measuring and for drawing. It can be used in a variety of ways, for a variety of purposes and the variations of the situations and circumstances of use are endless.

More specifically, another object is to provide a universal triangle implement for accomplishing tasks such as measuring existing angles (e.g. protractor) drawing angles, drawing perspective lines, drawing geometric figures, drawing parallel lines, drawing concentric circles (e.g. compass), measuring distance between points, drawing concentric/radial lines and the like.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF PREFERRED EMBODIMENTS

Figure 1:
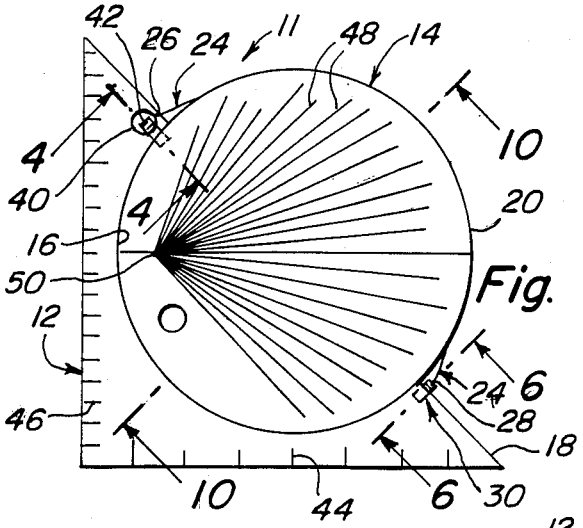
FIG. 1 is a plan view of the invention.

Referring now to the Drawing in greater detail, and more particularly to FIGS. 1,4,5,6,7 and 10 thereof at this time, the reference numeral 11 represents a universal triangle implement according to the present invention, wherein there is a flat, 45°, isosceles right triangle 12 and a flat, circle disk 14, both of which are made of transparent, semi-rigid plastic that may be either color-tinted or clear. They typically may be approximately ⅛ to 3/16 inch thick and may be of any convenient size.

The triangle 12 has a semi-circular arcuated notch portion removed and hereafter referred to as a notch 16 along its hypotenuse edge 18, whereby the circular disk 14, is removably seated in the notch 16. A groove 20 around the edge of the circular disk 14 receives a tongue 22 extending from the semi-circular edge of the notch 16 so that the circular disk 14 is rotatable in the notch 16. The circular disk 14 is retained in the notch 16 and prevented from falling out by a wire 24 which at each end is supported on the triangle 12 and is slidable inside the circular disk groove 20. The wire 24 urges the circular disk 14 to stay in the notch 16. One end 26, of the wire 24 is securely attached to the triangle 12 at the edge 18 adjacent notch 16, while at the opposite end 28 the wire 24 is removably secured by a wire clip 30.

Figure 6:
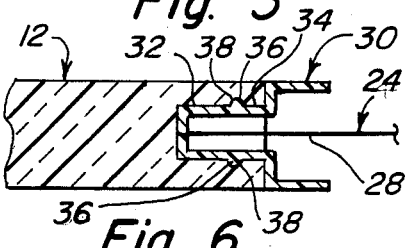
FIG. 6 is an enlarged partial cross sectional view taken on line 6—6 in FIG. 1.
Figure 7:
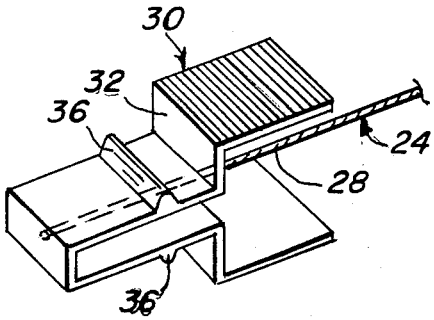
FIG. 7 is a perspective view of the wire clip shown in FIG. 6.

As shown in FIGS. 6 and 7, the wire clips 30 includes the flexible spring wire 24 mounted on a leaf spring base 32 retained in a slot 34 of the triangle 12 by detents 36 in recesses 38 of the triangle 12.

A circular hole 40 through the triangle 12 allows a person's thumb to depress against a thumb lock spring 42 so as to permit the grove 20 of the circular disk 14 to freely rotate in the tongue 22 of the notch 16.

A linear inch scale 44 is marked along one side edge of the triangle 12 and a linear metric scale 46 is marked along another edge thereof (I.E. compass).

As shown in FIG. 1, the circular disk 14 has a plurality of radially extending slots 48 at various angles radiating from a point 50 in which the slots permit a pencil (not shown) to draw a line therein. A periphery of the circular disk 14 may be marked with a 360° protractor increments therearound (not shown). A row of small holes (not shown) between the slots 48 permit receiving a pencil point so that circles of different sizes can be drawn by rotating the circular disk 14.

The universal triangle implement, 11 as shown in FIG. 1 may be used with either side up and the circular disk 14 may be replaced with other circular disks carrying other drawing aids of various sorts.

Figure 2:
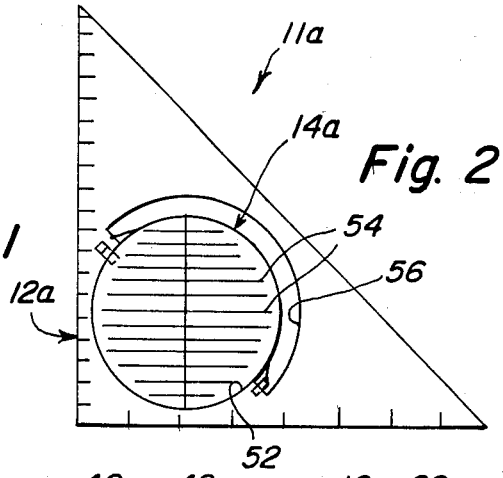
FIG. 2 is a plan view of a first modification.

In a modified design of the universal triangle implement **11*a*, shown in FIG. 2, the circular disk 14*a* is smaller in size relative to the triangle 12*a* so as to be fully contained in an opening 52** within the borders of the triangle.

The circular disk **14*a* is marked with a plurality of parallel, spaced apart slots 54 for receiving the pencil point. Rows of holes (not shown) may be provided between the slots 54. A relief 56 in the triangle 12*a*** provides access to a semi-circular length of the circular disk edge for drafting purposes.

Figure 3:
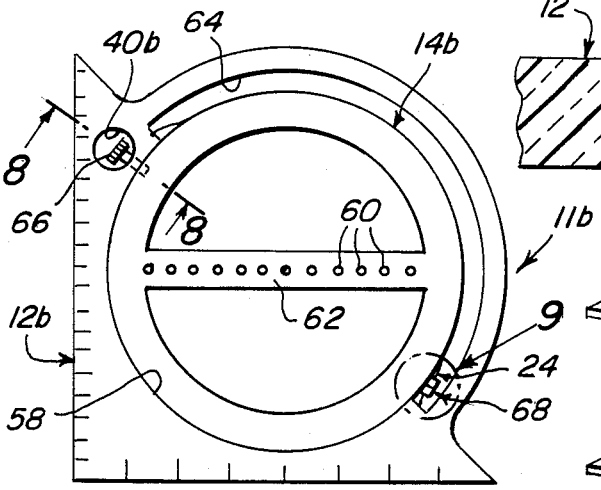
FIG. 3 is a plan view of a second modification.
Figure 4:
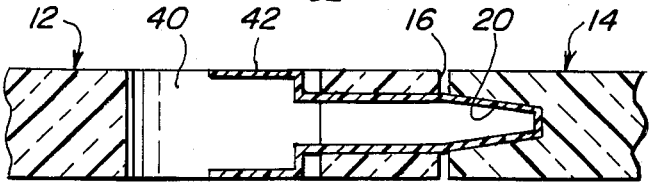
FIG. 4 is an enlarged partial cross sectional view taken on line 4—4 in FIG. 1.
Figure 5:
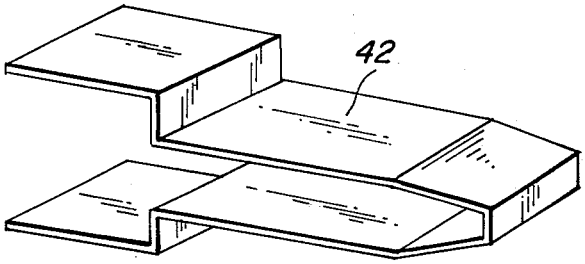
FIG. 5 is a perspective view of the thumb lock spring shown in FIG. 4.

In a modified design of universal triangle implement **11*b*, shown in FIG. 3, the circular disk 14*b* is larger in size relative to the triangle 12*b* and is fully contained in an opening 58 within the borders of the triangle. The circular disk 14*b* includes a row of small holes 60 which are provided along a center bar member 62 for receiving the pencil point. A relief 64 in the triangle 12***b* provides access to a semicircular arc of the circular disk edge for drafting purposes.

Figure 8:
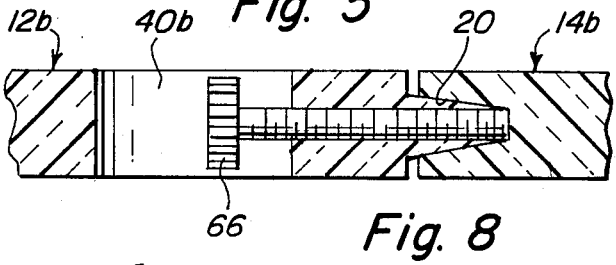
FIG. 8 is an enlarged partial cross sectional view showing a thumb screw, taken on line 8—8 in FIG. 3.
Figure 9:
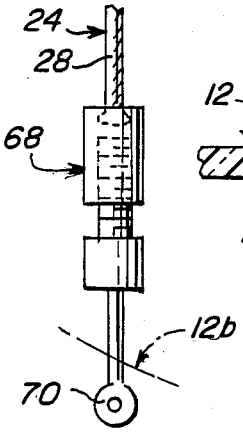
FIG. 9 is an enlarged detail view of the area 9 indicated in FIG. 3.
Figure 10:
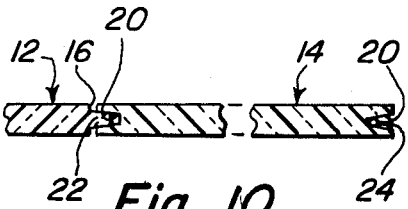
FIG. 10 is an enlarged partial cross sectional view taken on line 10–10 in FIG. 1.

FIGS. 3, 8 and 9 illustrate numerous other variations of a universal triangle implement 11*b* which incorporate other elements heretofore not indicated. The universal triangle implement 11*b* uses a thumbscrew 66 within circular hole 40*b* instead of the thumb lock spring 42, described above, for frictional arrest of the circular disk rotation. A small turn buckle 68 is substituted for the wire clip 30 and is securely attached to the triangle 12*b* by an eye 70. The circular disk 14*b* may include the above described 360° protractor increment feature as well as other features.

The present invention is not limited to a 45° isosceles right triangle, but may be a 30°–60° right triangle, or any other type of triangle as well.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A universal triangle implement comprising in combination, a right triangle and a circular disk rotatably supported on said triangle, said triangle and said circular disk each including various measurement and drafting aid means, said triangle comprising a semi-circular notch forming a seat to rotatbly receive said disk, a groove formed in the periphery of said disk, a tongue projecting from the periphery of the notch and sidably engaging said groove, a removable wire extending around said groove whereby said disk is retained in said notch and can freely rotate with respect to the triangle, lock means extending from the triangle into the groove for locking the disk in a desired place with respect to the triangle, and means for adjusting the tension in said wire to control the ease of rotation of the disk with respect to the triangle.

2. The combination as set forth in claim 1, wherein means are included for interchanging said circular disk and said triangle with other circular disks or triangles having different said measurements and drafting aids.

3. The combination as set forth in claim 1, wherein said triangle and said circular disk are made of transparent plastic flat material.

4. The combination as set forth in claim 3, wherein said triangle and said circular disk are made of any different size.

5. The combination as set forth in claim 4, wherein said circular disk is seated in a notch along a hypotenuse side of said triangle.

6. The combination as set forth in claim 4, wherein said circular disk is seated in an opening within the confines of all sides of said triangle.

* * * * *